US005390516A

United States Patent [19]

Alchin

[11] Patent Number: 5,390,516

[45] Date of Patent: Feb. 21, 1995

[54] PUSHBUTTON LOCK FOR SLIDING DOORS

[75] Inventor: Michael Alchin, Orchard Hills, Australia

[73] Assignee: Dowell Australia Limited, Victoria, Australia

[21] Appl. No.: 20,822

[22] Filed: Feb. 19, 1993

[51] Int. Cl.[6] ..... F05B 65/08

[52] U.S. Cl. ..... 70/100; 292/98; 292/129; 292/229; 292/DIG. 46; 292/DIG. 37; 292/DIG. 60; 70/95

[58] Field of Search ..... 292/DIG. 46, 98, 129, 292/97, 106, 229, 196, 197, 207, 195, 96, DIG. 37, 248; 70/95, 90, 89, 96, 137, 97, 99–100

[56] References Cited

U.S. PATENT DOCUMENTS

| | | | |
|---|---|---|---|
| 2,221,110 | 11/1940 | Ross | 292/DIG. 37 |
| 2,862,378 | 12/1958 | Harris | 292/DIG. 46 |
| 2,883,227 | 4/1959 | Hoofe, III | 292/DIG. 46 |
| 3,563,068 | 2/1971 | Dushane, Jr. | 70/100 |
| 4,932,694 | 6/1990 | Cater, Sr. | 292/DIG. 46 |
| 4,995,649 | 2/1991 | Magnusson | 292/DIG. 46 |
| 5,028,082 | 7/1991 | Kronbetter | 292/DIG. 21 |
| 5,172,520 | 12/1992 | Hostetler et al. | 292/DIG. 46 |

*Primary Examiner*—Peter M. Cuomo
*Assistant Examiner*—Darnell M. Boucher
*Attorney, Agent, or Firm*—Foley & Lardner

[57] ABSTRACT

A lock or catch (10) is shown for a sliding door or window. The lock has a tongue (13) which can pivot to engage or disengage with a fixed frame part of a frame in which the door or window can slide. The lock has two buttons (16,17) which are respectively operable to move a lock (20,21,23,25,31) so the tongue (13) is moved to a first position (such as an unlocked condition) and to a second position (such as a locked condition).

A cylinder lock (not shown) can be used to lock the lock and therefore the tongue (13) in a locked condition.

11 Claims, 4 Drawing Sheets

PUSHBUTTON LOCK FOR SLIDING DOORS

TECHNICAL FIELD

The present invention relates to locks, catches and latches and more particularly to such items for sliding doors and windows.

BACKGROUND OF THE INVENTION

Catches for sliding windows frequently just consist of a handle which is pivotally mounted on the window, and is movable to engage a lip on the surrounding frame. The handle is biased to a lip engaging grip position by means of a spring. When the catch is to be released, the user must pivot the handle and then must simultaneously pull on the window or door to cause sliding horizontal movement thereof to permit its opening.

The above operation is sometimes difficult. Still further, the above discussed arrangement does not provide a key lock to retain the handle locked in the grip position.

OBJECT OF THE INVENTION

It is the object of the present invention to overcome or substantially ameliorate the above disadvantages.

SUMMARY OF THE INVENTION

There is disclosed herein a lock to prevent relative movement between two elements, said lock comprising:

a base to be secured to a first one of said elements;

a lock tongue to engage the other element to retain said other element fixed with respect to said first element, said lock tongue being mounted for movement between a retaining position with respect to said other element and a release position permitting separation of the elements;

lock means to selectively retain said tongue in said retaining position, said lock means being moveable between a first position maintaining said tongue in said retaining position and a second position permitting movement of said lock tongue to its release position;

a first user operable means mounted on said base and operatively associated with said lock means so that upon manipulation of said first user operable means, said lock means is moved to its second position; and second user operable means mounted on said base and operatively associated with said lock means so that upon manipulation of said second user operable means, said lock means is moved to its first position.

Preferably said first user operable means and said second user operable means are respective first button means and second button means.

Preferably, the lock means is biased to its first position, said second user operable means moves the lock tongue to its retaining position whereat it is engaged by said lock means by movement thereof to its first position, and said tongue is biased to its release position.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
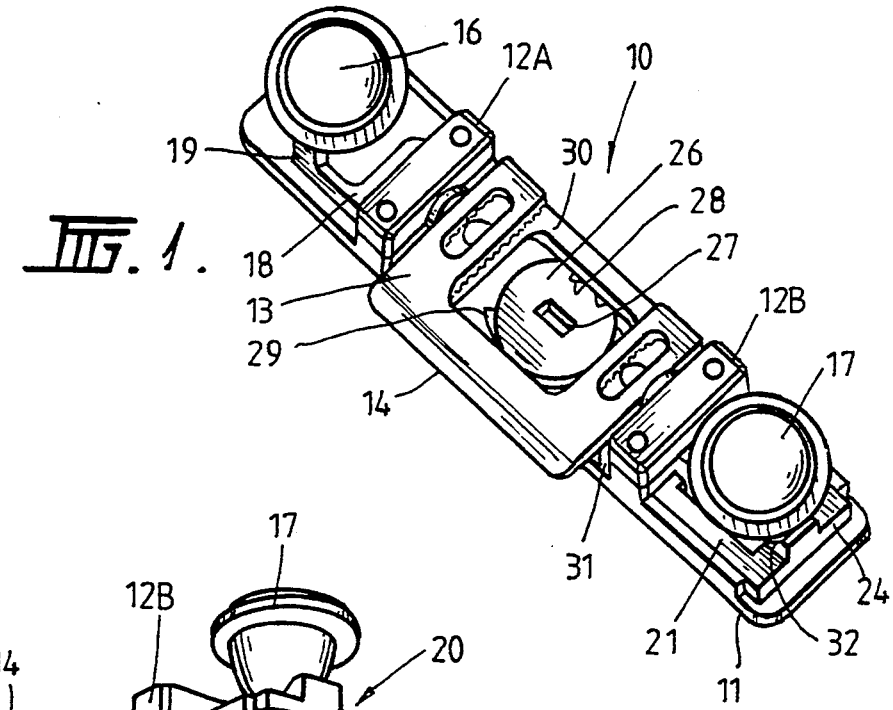
FIG. 1 is a schematic top perspective view of a window lock.
Figure 2:
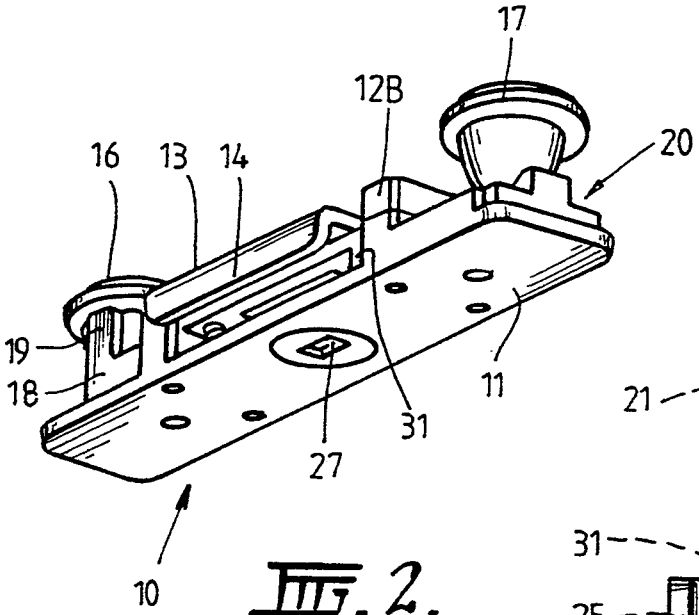
FIG. 2 is a schematic bottom perspective view of the lock of FIG. 1.
Figure 3:
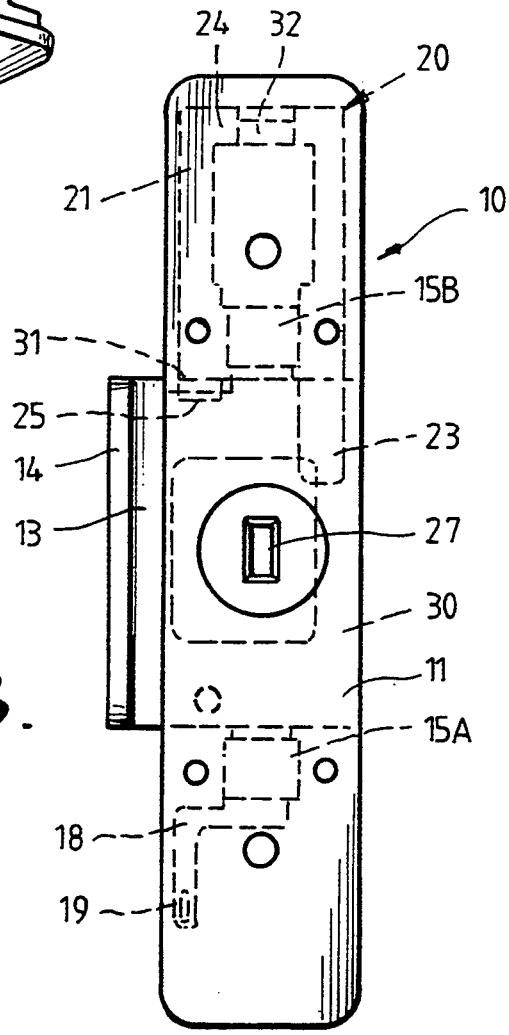
FIG. 3 is a schematic bottom plan view of the lock of FIG. 1.
Figure 4:
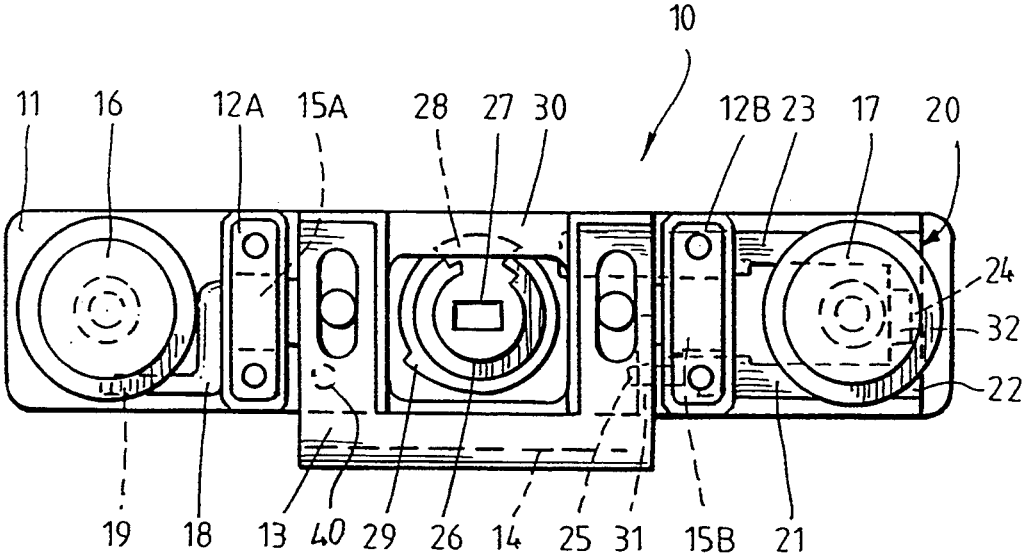
FIG. 4 is a schematic top plan view of the lock of FIG. 1.
Figure 5:
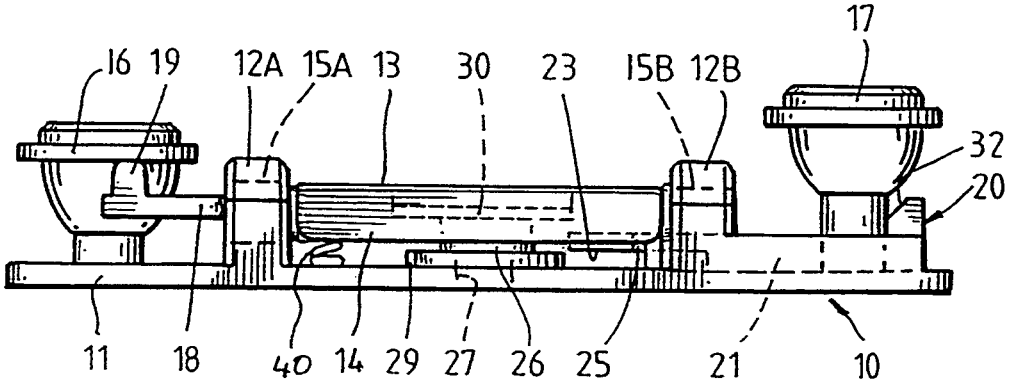
FIG. 5 is a schematic front elevation of the lock of FIG. 1 with lock tongue in the locked position and the lock barrel lock in a locked position.
Figure 6:
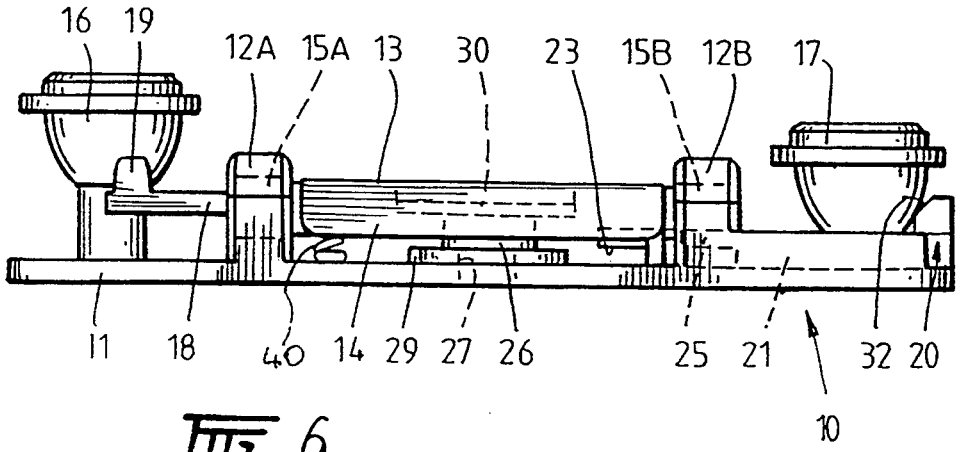
FIG. 6 is a view similar to that of FIG. 5, showing the lock tongue ready for movement to an unlocked position.

In the accompanying drawings there is schematically depicted a lock 10 to be used in conjunction with a sliding door or window, to retain the door or window closed. For example, the lock 10 could be mounted on the door frame and engage a lip on the sliding door. Alternatively the positions may be reversed. The same applies to a sliding window.

The lock 10 includes a base 11 which may be secured to the fixed or moving element. The base 11 includes a pair of pivot pedestals 12A and 12B which pivotally support a lock tongue 13 having a lip 14 to engage an associated lip of the other element. The lock tongue 13 is pivotally movable between a release position and a retaining position. The lock tongue 13 has laterally extending axles 15A and 15B which are received within the pedestals 12A and 12B.

Mounted on the base 11 for reciprocating movement relative thereto are user operable means in the form of buttons 16 and 17. The button 16 is the latch button, while the button 17 is the release button. When the button 16 is actuated, the tongue 13 is pivoted to its retaining position and is maintained therein. When the button 17 is pushed, the tongue 13 is permitted to move to its release position.

Extending from the axle 15A is a lever 18 which has an abutment 19 positioned below the button 16. Accordingly when the button 16 is depressed, the lock tongue 13 is pivoted to its retaining position.

Operatively associated with the button 17 is a lock slide 20 which is of generally "U-shaped" configuration so as to have a base 22 and a pair of legs 21 and 23. The base 22 is provided with a cam abutment 24 having a sloping cam surface 32 which engages the lower surfaces of the button 17. The leg 21 extends beneath the pedestal 12B to project into the path of movement of the tongue 13. More particularly, the tongue 13 is provided with an eyelet 31 adjacent the pedestal 12B, which eyelet 31 is engaged by the extremity 25 of the leg 21 (see FIG. 7).

The leg 23 extends beneath the pedestal 12B to adjacent a second lock means comprising a rotatably mounted disc 26.

Extending between the tongue 13 and the base 11 is a spring 40 biasing the tongue 13 to its release position. The lock slide 20 is movable between a first position (FIG. 7) having the extremity 25 engaged with the eyelet 31 of the tongue 13, and a second position (FIG. 8) having the extremity 25 spaced from the eyelet 31 and thereby permitting movement of the tongue 13 to its release position. A further spring (not shown) extends between the lock slide 20 and the base 11 to bias the lock slide 20 to its first position, that is to move the extremity 25 into engagement with the eyelet 31.

In operation of the above described lock 10, the tongue 13 will stay in its release position until the button 16 is depressed. When the button 16 is depressed, the tongue 13 is moved to its retaining position. The eyelet 31 is then aligned with the extremity 25, and under the influence of the associated spring, the lock slide 20 moves to locate the extremity 25 within the eyelet 31. The lock tongue 13 is then maintained in its retaining position. When the button 17 is operated, the lock slide 20 is moved to its second position having the extremity 25 clear of the eyelet 31. Under the influence of the spring 40, the lock tongue 13 then pivots to its release position. The slide 20 has its cam surface 32 engaged by the undersurface of the button 17 to cause movement of the slide 20.

The above described lock 10 is intended to be provided with a housing. Mounted in that housing is a key operated cylinder lock having a blade concentric with the longitudinal axis of the cylinder lock, or an eccentrically mounted projection. Upon operation of the key, the blade or projection is rotated about the longitudinal axis of the cylinder lock. The blade or projection is received in a slot 27 of the disc 26. The cylinder lock is usable to rotate disc 26 via the slot 27 therein. The disc 26 is also provided with an abutment 28 and a cam member 29. When the cylinder lock is rotated to its lock position, the disc 26 is rotated to position the abutment 28 beneath the bar 30 of the lock tongue 13 (see FIG. 8). This then maintains the lock tongue 13 in its retaining position. In this respect it should be appreciated that once moved to this position, the extremity 25 automatically moves into engagement with the eyelet 31. Accordingly there are two separate lock mechanisms which maintain the lock tongue 13 in this retaining position.

Figure 7:
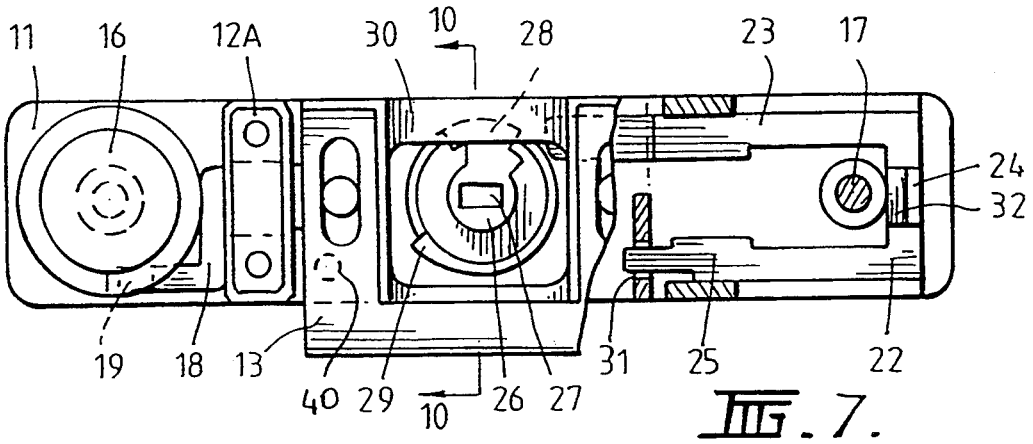
FIG. 7 is a top plan view, partially in cross-section, of the lock, with the lock tongue being shown in a locked position.
Figure 8:
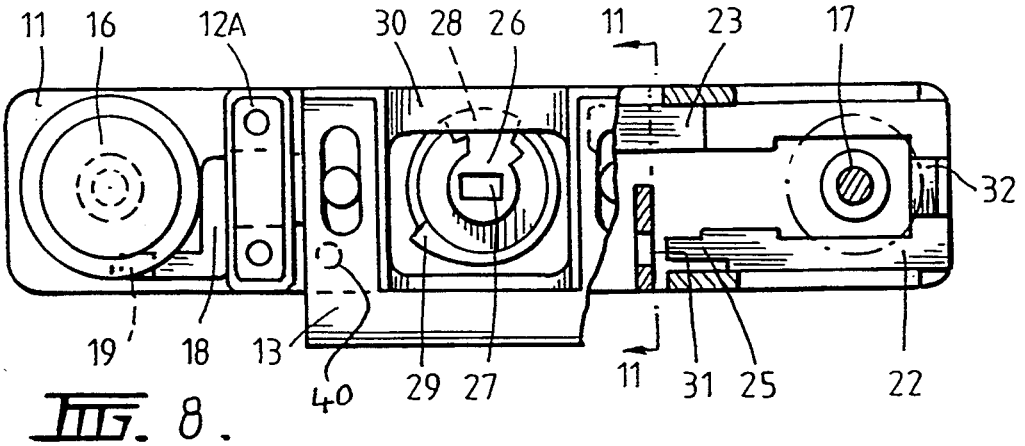
FIG. 8 is a view similar to FIG. 7, with the lock tongue being moved to the unlocked position but being unable to be moved until the lock barrel lock is rotated to the unlocked position.
Figure 9:
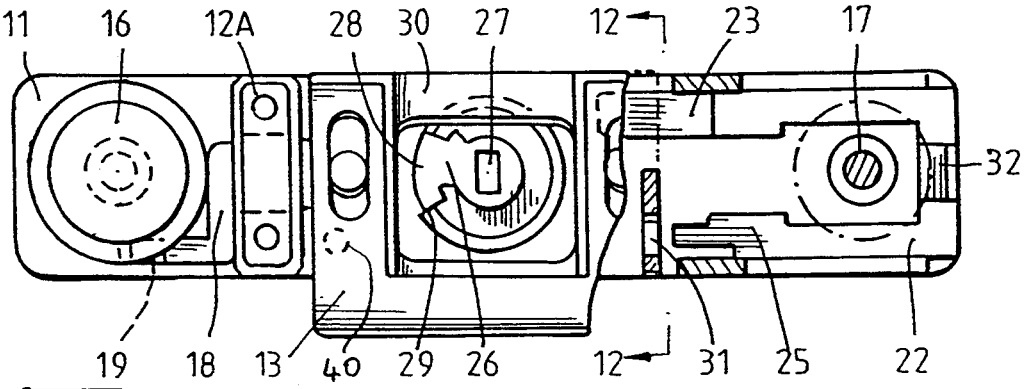
FIG. 9 is a view similar to FIG. 8 but showing the lock barrel lock having rotated to an unlocked position.
Figure 10:
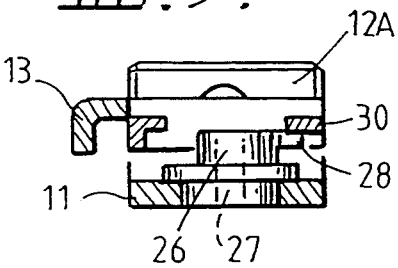
FIG. 10 is a sectional view taken on line 10—10 of FIG. 7.
Figure 11:
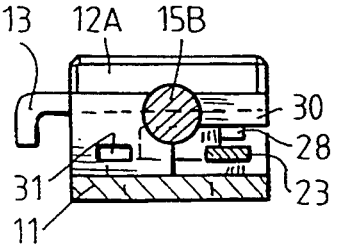
FIG. 11 is a sectional view taken on line 11—11 of FIG. 8.
Figure 12:
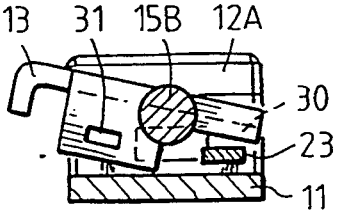
FIG. 12 is a sectional view taken on line 12—12 of FIG. 9.
Figure 13:
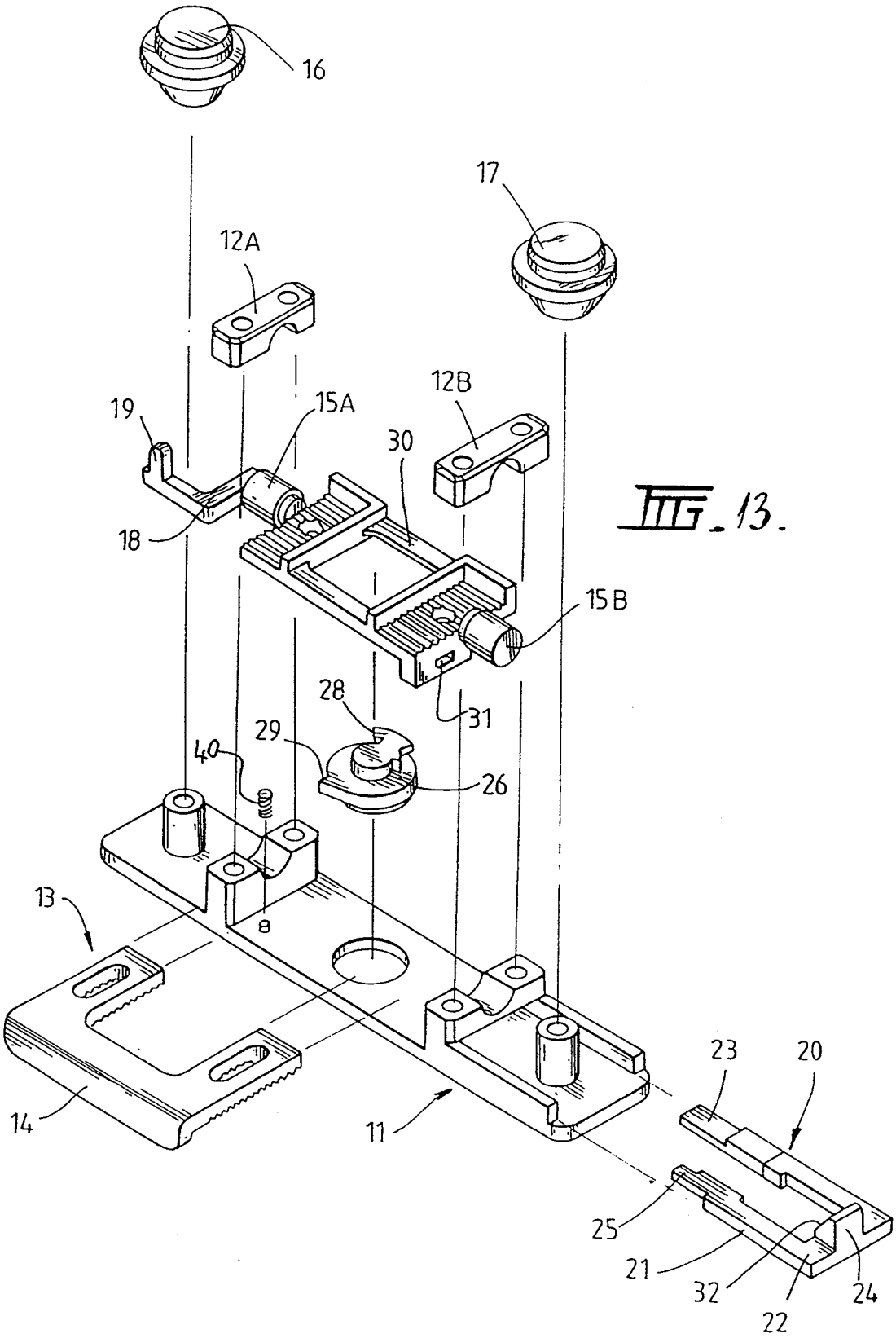
FIG. 13 is an exploded perspective view illustrating the various components of the lock.

When the cylinder lock is key operated to be rotated clockwise to its unlocked position, the cam member 29 is moved until it engages an extension of the leg 23 which passes beneath the pedestal 12B (see FIG. 7). The cam member 29 causes movement of the leg 23 to the right as viewed in FIG. 7, to correspondingly move the lock slide 20 to its second or release position. Accordingly the abutment 28 is moved from beneath the bar 30, and the extremity 25 moved from its eyelet 31. The lock tongue 13 is then free to move to its release position.

The claims defining the invention are as follows:

1. A lock to prevent relative sliding apart movement between two elements, said lock comprising:

a base to be secured to a face of a first one of said elements which face is generally parallel to the direction of sliding apart movement;

a lock tongue to engage the other element to retain said other element fixed with respect to said first element, said lock tongue being mounted for movement between a retaining position with respect to said other element and a release position permitting separation of the elements;

lock means to selectively retain said tongue in said retaining position, said lock means being moveable between a first position maintaining said tongue in said retaining position and a second position permitting movement of said lock tongue to its release position;

first and second user operable means separate from and independent of said lock tongue and mounted on said base and operatively associated with said lock means so that upon manipulation of said first user operable means, said lock means is moved to its second position, and, upon manipulation of said second user operable means, said lock means is moved to its first position; and wherein said lock tongue is pivotally mounted for movement between its retaining and release positions about a pivot axis which extends perpendicular to said direction of sliding apart movement so said lock tongue can move inward of said face for retaining, and outward of said face for releasing, and said first and second user operable means are mounted for operative movement in a direction normal to said pivot axis.

2. The lock of claim 1, wherein said first user operable means and said second user operable means are respective first and second buttons.

3. The lock of claim 1, wherein said lock means is biased to its first position, said second user operable means permits movement of said tongue to its retaining position whereat said tongue is engaged by said lock means by movement thereof to its first position, and said tongue is biased to move to said release position.

4. The lock of claim 1, wherein said tongue includes an engagement portion, and said lock means includes a lock member, said lock member being moveable between a first and a second position, with said lock member in its first position engaging said engagement portion to retain said tongue in its retaining position, said lock member when in its second position being clear of said engagement portion to permit movement of said tongue to its release position.

5. The lock of claim 1, wherein said first user operable means causes movement of said lock means to its second position, and said second user operable means upon manipulation permits movement of said lock means to its first position.

6. The lock of claim 4, further including means biasing said lock member to its first position.

7. The lock of claim 1, wherein said lock means is slidably mounted for linear movement on said base.

8. The lock of claim 2, wherein said first and second buttons are located on opposite sides of said tongue.

9. The lock of claim 1, further including a second lock member movable between a first position maintaining said tongue in its retaining position, and a second position permitting movement of said tongue to its release position.

10. The lock of claim 9, wherein said second lock member is a disc rotatably mounted on said base, said disc being adapted to be rotated between its first and second positions by means of a cylinder lock.

11. The lock of claim 9, wherein said second lock member includes engaging means to engage said lock means to move said lock means to its second position when said second lock member is moved to its second position.

* * * * *